US009708932B2

(12) United States Patent
Jinnai et al.

(10) Patent No.: US 9,708,932 B2
(45) Date of Patent: Jul. 18, 2017

(54) TURBINE HOUSING ASSEMBLY

(71) Applicant: MITSUBISHI HEAVY INDUSTRIES, LTD., Tokyo (JP)

(72) Inventors: Yasuaki Jinnai, Tokyo (JP); Hiroyuki Arimizu, Tokyo (JP); Koen Kramer, Almere (NL)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 216 days.

(21) Appl. No.: 14/386,425

(22) PCT Filed: Mar. 22, 2013

(86) PCT No.: PCT/JP2013/058396

§ 371 (c)(1),
(2) Date: Sep. 19, 2014

(87) PCT Pub. No.: WO2013/141380

PCT Pub. Date: Sep. 26, 2013

(65) Prior Publication Data

US 2015/0044034 A1 Feb. 12, 2015

(30) Foreign Application Priority Data

Mar. 23, 2012 (JP) ..... 2012-068210

(51) Int. Cl.
*F01D 25/24* (2006.01)
*F01D 9/02* (2006.01)
*F01D 17/14* (2006.01)

(52) U.S. Cl.
CPC ..... *F01D 25/24* (2013.01); *F01D 9/026* (2013.01); *F01D 17/14* (2013.01);
(Continued)

(58) Field of Classification Search
CPC ..... F01D 9/026; F01D 25/14; F01D 25/145; F01D 25/24; F04D 29/44; F05D 2230/232
See application file for complete search history.

(56) References Cited

U.S. PATENT DOCUMENTS 4,850,797 A * 7/1989 Benson ..... F01D 9/026 285/261
6,553,762 B2 * 4/2003 Loffler ..... F01D 9/026 415/203

(Continued)

FOREIGN PATENT DOCUMENTS

CN 1508435 A 6/2004
CN 102127674 A 7/2011

(Continued)

OTHER PUBLICATIONS

Extended European Search Report effective Mar. 14, 2016 issued in related Application No. EP 13764441.5.

(Continued)

*Primary Examiner* — Gregory Anderson
*Assistant Examiner* — Maxime Adjagbe
(74) *Attorney, Agent, or Firm* — Birch, Stewart, Kolasch & Birch, LLP

(57) ABSTRACT

An object is to provide a turbine housing assembly in which reduction of weight, facilitation of manufacture, cost-cutting, and reduction of heat capacity are further promoted compared to a conventional turbine housing made of sheet metal. A turbine housing assembly includes a plurality of constituent members connected to one another to constitute a turbine housing into which a turbine wheel is inserted. The turbine housing assembly at least includes a scroll part 2 and an exhaust part 8 of a tubular shape having a separate body separate from the scroll part 2. The scroll part 2 is formed by processing a single piece of sheet metal so that, on a back face side of a bottom face part 22 of the scroll part 2, a recess portion 22*b* on which a through-hole of an exhaust gas outlet 2B is formed and a projecting portion 22*a* formed by a bottom surface of an exhaust gas flow path 2A projecting toward the back face side are formed, the projecting portion 22*a* surrounding the recess portion 22*b*. The recess portion (Continued)

22*b* of the scroll part 2 is connected to an end portion 8*a* of the exhaust part 8 in a turbine axial direction so that the exhaust part 8 is in communication with the exhaust gas outlet 2B of the scroll part 2 in a state where a gap "a" is formed between an outer circumferential face of the exhaust part 8 and the projecting portion 22*a* of the scroll part 2.

10 Claims, 9 Drawing Sheets

(52) U.S. Cl.
CPC .... *F05D 2220/40* (2013.01); *F05D 2230/232* (2013.01); *F05D 2250/51* (2013.01)

(56) References Cited

U.S. PATENT DOCUMENTS

| | | | | |
|---|---|---|---|---|
| 7,198,459 | B2 * | 4/2007 | Grussmann | F01D 9/026 415/134 |
| 2006/0133931 | A1 | 6/2008 | Kosaka | |

FOREIGN PATENT DOCUMENTS

| | | | |
|---|---|---|---|
| CN | 102203396 | A | 9/2011 |
| DE | 10 2004 039 477 | A1 | 2/2006 |
| EP | 1 357 278 | A2 | 10/2003 |
| JP | 61-132800 | A | 6/1986 |
| JP | 2006-527322 | A | 11/2006 |
| JP | 2007-224827 | A | 9/2007 |
| JP | 2008-57448 | A | 3/2008 |
| JP | 2011-174460 | A | 9/2011 |

OTHER PUBLICATIONS

Extended European Search Report effective May 24, 2016 issued in the corresponding EP Application No. 13764393.8.

Office Action effective Apr. 19, 2016 issued in corresponding Japanese Application No. 2012-068210 with an English Translation.

Chinese Office Action effective May 25, 2016, issued in corresponding Chinese Application No. 201380015195.0 with an English Translation.

Decision to Grant a Patent effective Jul. 14, 2016 issued in the corresponding Japanese Application No. 2012-068210 with an English Translation.

Decision to Grant a Patent effective Jul. 5, 2016 issued in related Japanese Application No. 2012-068209 with an English Translation.

International Preliminary Report on Patentability and Written Opinion of the International Searching Authority, (forms PCT/IB/338, PCT/IB/326, PCT/IB/373 and PCT/ISA/237), issued Oct. 2, 2014, for International Application No. PCT/JP2013/058389, along with an English translation of Written Opinion.

International Preliminary Report on Patentability and Written Opinion of the International Searching Authority, (forms PCT/IB/338, PCT/IB/326, PCT/IB/373 and PCT/ISA/237), issued Oct. 2, 2014, for International Application No. PCT/JP2013/058396, along with an English translation of Written Opinion.

International Search Report and Written Opinion of the International Searching Authority (forms PCT/ISA/210, PCT/ISA/220 and PCT/ISA/237), issued May 28, 2013, for International Application No. PCT/JP2013/058389.

International Search Report and Written Opinion of the International Searching Authority (forms PCT/ISA/210, PCT/ISA/220 and PCT/ISA/237), issued May 28, 2013, for International Application No. PCT/JP2013/058396, along with an English translation of the International Search Report.

Chinese Office Action effective Apr. 1, 2016 issued in related Chinese Application No. 201380015197 with an English Translation.

Notice of Allowance effective Dec. 27, 2016, issued in the related Chinese Application No. 201380015197.X with an English Translation.

Office Action mailed Feb. 9, 2017 in related U.S. Appl. No. 14/387,104.

* cited by examiner

TURBINE HOUSING ASSEMBLY

TECHNICAL FIELD

The present invention relates to a turbine housing assembly which includes a plurality of constituent members connected to one another to constitute a turbine housing into which a turbine wheel rotated by exhaust gas introduced from an engine may be inserted.

BACKGROUND

Conventionally, there has been known a turbocharger in which a turbine wheel is rotated by utilizing energy of exhaust gas introduced from an engine to rotate a compressor wheel disposed coaxially with the turbine wheel, so that pressurized air is supplied to an air-intake manifold, thereby improving output. In recent years, in the case where such a turbocharger is to be mounted on a vehicle, there is need for reduction of weight, cost-cutting, facilitation of manufacture, reduction of heat capacity, or the like. Thus, a turbine housing made of sheet metal has been increasingly used in the place of a conventional turbine housing made by casting.

As an example of a turbine housing made of sheet metal, Patent Document 1 discloses a turbine housing which includes a scroll part formed by bringing two right-and-left sheet metal members each having a plate-like shape or a bowl-like shape in contact with each other, and welding them in the circumferential direction, the scroll part having an exhaust gas flow path of a spiral shape formed inside. In addition, Patent Document 2 discloses a turbine housing including a housing of a scroll-like shape made of sheet metal and having an exhaust gas flow path of a spiral shape formed therein and an outer shell made of sheet metal, the outer shell being configured to cover the housing of a scroll-like shape.

CITATION LIST

Patent Literature

Patent Document 1: JP2008-57448
Patent Document 2: JP4269184B

SUMMARY

Technical Problem

However, for the above described turbine housing of Patent Document 1, the manufacture of the scroll part requires troublesome steps because the scroll part is formed by preparing two right-and-left sheet metal members each having a complex shape processed into a plate-like shape or a bowl-like shape, bringing the two members into contact with each other, and welding them in the circumferential direction. Further, although the scroll part made of sheet metal is directly connected to a bearing housing made by casting (FIG. 3), there is no disclosure regarding details of the connecting part.

Furthermore, the above described turbine housing of Patent Document 2 includes a housing, a bearing ring or the like fitted with one another, which negatively affects sealability of the housing with respect to exhaust gas. Thus, for the turbine housing of Patent Document 2, it is necessary to provide an outer shell for covering the housing of a scroll-like shape, which raises a problem in that it is difficult to reduce the weight and heat capacity of the turbine housing sufficiently.

The present invention was made in view of the above described problem of the prior art. An object is to provide a turbine housing assembly in which reduction of weight, facilitation of manufacture, cost-cutting, reduction of heat capacity are further promoted compared to a conventional turbine housing made of sheet metal.

The present invention was made to achieve the above described object. A turbine housing assembly includes a plurality of constituent members connected to one another to constitute a turbine housing into which a turbine wheel rotated by exhaust gas introduced from an engine is inserted. The turbine housing assembly at least includes: a scroll part of a bottomed cylindrical shape that has a surrounding wall part and a bottom face part, the scroll part including: an exhaust gas flow path of a spiral shape formed inside the bottomed cylindrical shape and configured such that exhaust gas that has flowed in from an exhaust gas inlet flows through the exhaust gas flow path; and an exhaust gas outlet having a through hole formed on the bottom face part, the exhaust gas outlet being configured such that the exhaust gas that has flowed through the exhaust gas flow path flows out from the exhaust gas outlet; and an exhaust part of a tubular shape comprising a separate body separate from the scroll part, the scroll part being formed by processing a single piece of sheet metal so that, on a back face side of the bottom face part of the scroll part, a recess portion through which the exhaust gas outlet is formed and a projecting portion formed by a bottom surface of the exhaust gas flow path projecting toward the back face side are formed, the projecting portion surrounding the recess portion, and the recess portion of the scroll part being connected to an end portion of the exhaust part in a turbine axial direction so that the exhaust part is in communication with the exhaust gas outlet of the scroll part in a state where a gap is formed between an outer circumferential face of the exhaust part and the projecting portion of the scroll part.

In the turbine housing assembly of the present invention configured as above, a turbine housing is broken down into modules such as the scroll part inside which the exhaust gas flow path of a spiral shape is formed and the exhaust part of a tubular shape, and the scroll part is formed by processing a single piece of sheet metal. Further, the recess portion of the scroll part and the end portion of the exhaust part are connected to each other in the turbine axial direction, so that the exhaust part and the exhaust gas outlet of the scroll part are in communication in a state where the gap is formed between the outer circumferential face of the exhaust part and the projecting portion of the scroll part.

As described above, since a turbine housing is broken down into modules such as the scroll part and the exhaust part, the scroll part being formed by processing a single piece of sheet metal, it is possible to reduce the heat capacity and weight of the turbine housing. Also, since the scroll part is formed by processing a single piece of sheet metal, its manufacture is facilitated.

Further, since a turbine housing is broken down into modules such as the scroll part and the exhaust part, the exhaust part being brought into communication with the exhaust gas outlet of the scroll part in a state where the gap is formed between the outer circumferential face of the exhaust part and the projecting portion of the scroll part, it becomes difficult for the exhaust gas having a high temperature and flowing through the exhaust gas flow path to affect the exhaust part. Thus, it is possible to form the exhaust part of a material having lower heat resistance than that of the scroll part, i.e., a less expensive material containing less nickel than the scroll part. As a result, it is possible to reduce the cost of the turbine housing.

In the above invention, it is desirable that a rib is formed between the outer circumferential face of the exhaust part and the projecting portion of the scroll part. With such a rib formed between the outer circumferential face of the exhaust part and the projecting portion of the scroll part, the scroll part and the exhaust part are connected even more securely.

Further, in the present invention, it is desirable that the turbine housing assembly further includes a connection part connectable to a bearing housing that houses a bearing for supporting a rotation shaft of the turbine wheel, the connection part being formed by processing a single piece of sheet metal so as to have a separate body separate from the scroll part, and that the scroll part and the connection part are each welded to an annular lid part that is orthogonal to the turbine axial direction so as to be connected to each other in the turbine axial direction via the annular lid part.

As described above, by breaking down a turbine housing into modules such as the scroll part, the exhaust part, and the connection part, the connection part being configured to have a separate body separate from the scroll part, it is possible to form each constituent member included in the turbine housing assembly of the present invention into a simple shape, thereby facilitating the manufacture of each constituent member. Further, since the scroll part and the connection part are connected to each other in the turbine axial direction via the annular lid part orthogonal to the turbine axial direction, constituent members included in the turbine housing assembly of the present invention such as the connection part, the annular lid part, the scroll part and the exhaust part are all connected in the turbine axial direction. As a result, assembling property of the turbine housing assembly is improved.

Also, since a turbine housing is broken down into modules such as the scroll part inside which the exhaust gas flow path of a spiral shape is formed, the exhaust part of a tubular shape, and the connection part configured connectable to a bearing housing, it is possible to configure the turbine housing assembly of the present invention as an assembly of a plurality of standardized constituent modules. As a result, it possible to facilitate the manufacture.

Further, in addition to the scroll part, the connection part is also formed by processing a single piece of sheet metal. Thus, it is possible to reduce the heat capacity and weight of the turbine housing. Also, since the connection part is formed by processing a single piece of sheet metal, its manufacture is facilitated.

Moreover, since the turbine housing is broken down into modules such as the scroll part, the exhaust part and the connection part, the scroll part and the connection part being connected to each other by welding, the sealability is enhanced and thus the conventional outer shell is no longer required. As a result, it is possible to reduce the weight and heat capacity of the turbine housing.

Still further, since the turbine housing is broken down into modules such as the scroll part, the exhaust part and the connection part, the scroll part and the connection part being connected to each other in the turbine axial direction via the annular lid part that is orthogonal to the turbine axial direction, it is possible to block the influence of the exhaust gas having a high temperature in the scroll part by the annular lid part.

The turbine housing assembly of the present invention with the above configuration includes a variable nozzle mechanism that adjusts flow of the exhaust gas flowing into the turbine wheel, the variable nozzle mechanism being inserted into the scroll part and the connection part. In other words, the turbine housing assembly constitutes a turbine housing of a variable geometry turbocharger.

According to the present invention, it is possible to provide a turbine housing assembly in which reduction of weight, facilitation of manufacture, cost-cutting, reduction of heat capacity are even more promoted compared to a conventional turbine housing made of sheet metal.

DETAILED DESCRIPTION

Embodiments of the present invention will now be described in detail with reference to the accompanying drawings. It is intended, however, that unless particularly specified, dimensions, materials, shapes, relative positions and the like of components described in the embodiments shall be interpreted as illustrative only and not limitative of the scope of the present invention.

Figure 1:
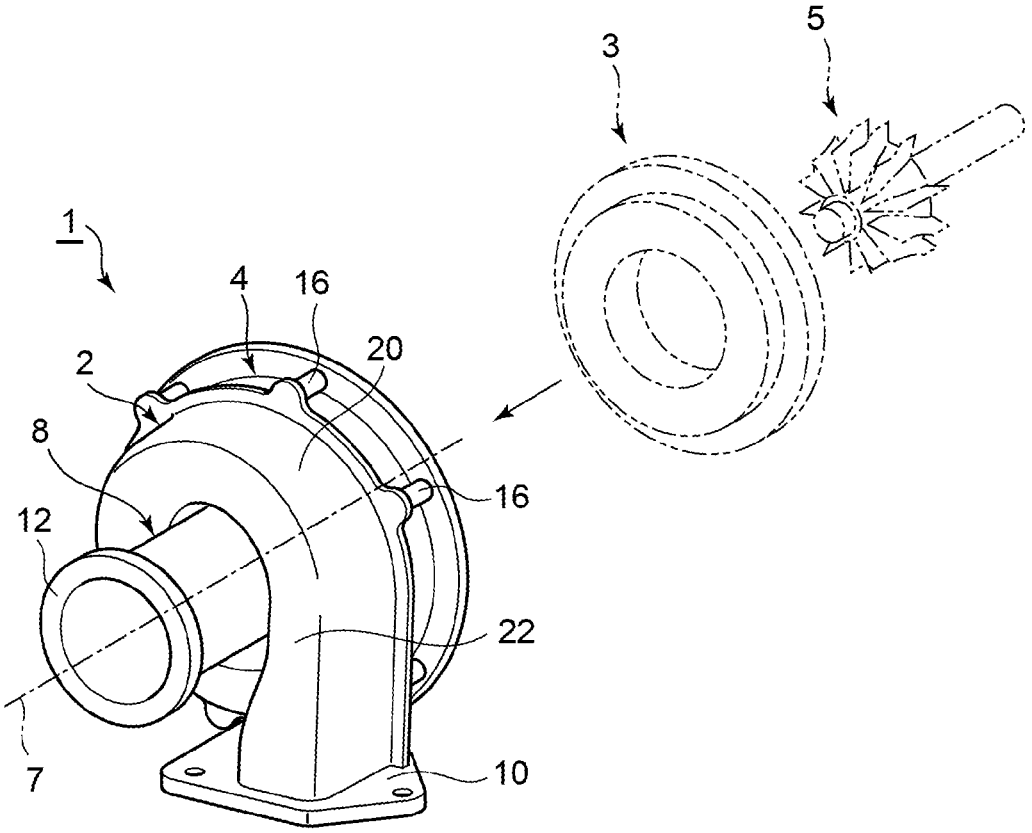
FIG. 1 is a perspective view of a turbine housing assembly of the present invention.
Figure 2:
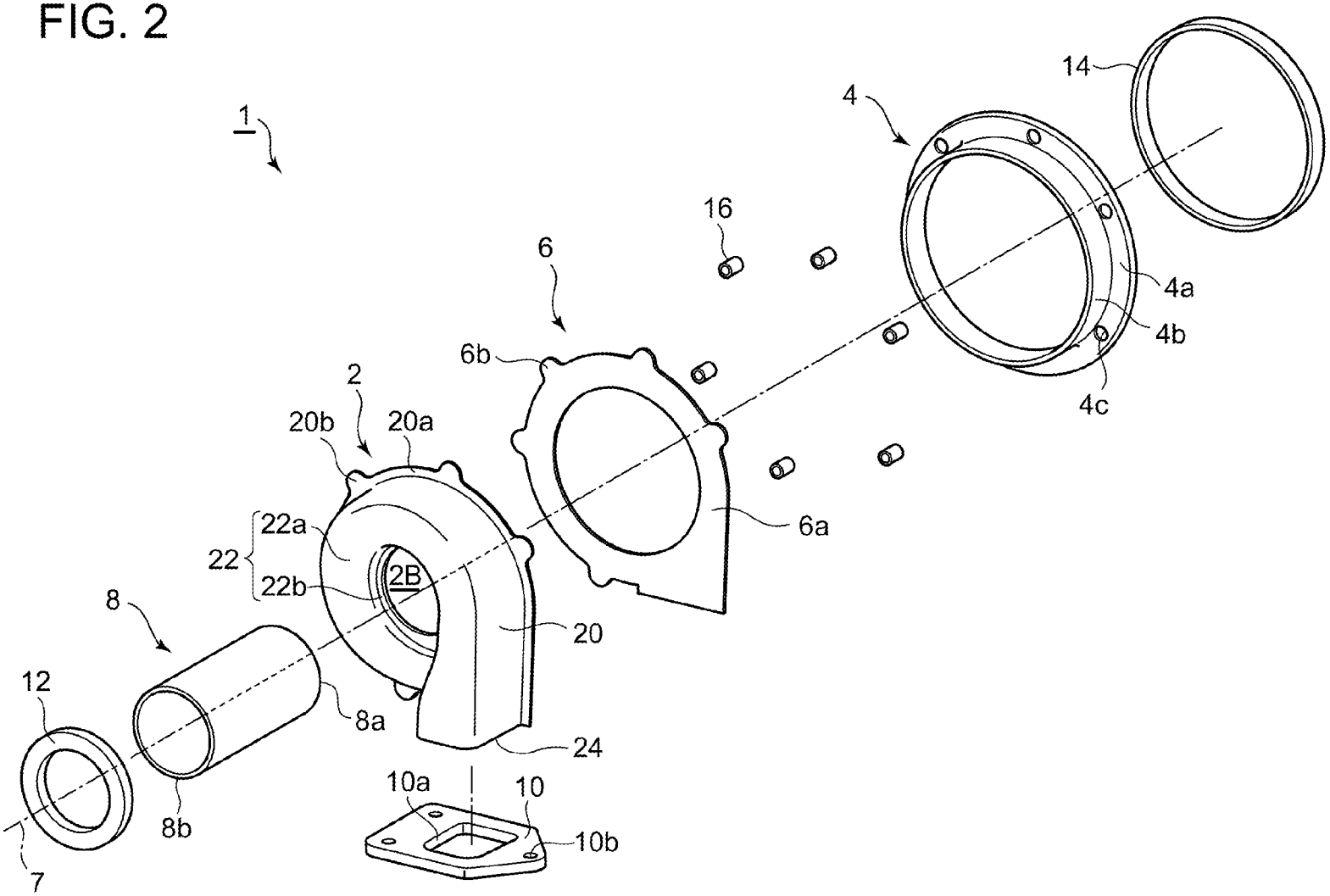
FIG. 2 is an exploded perspective view of the turbine housing assembly of the present invention.
Figure 3:
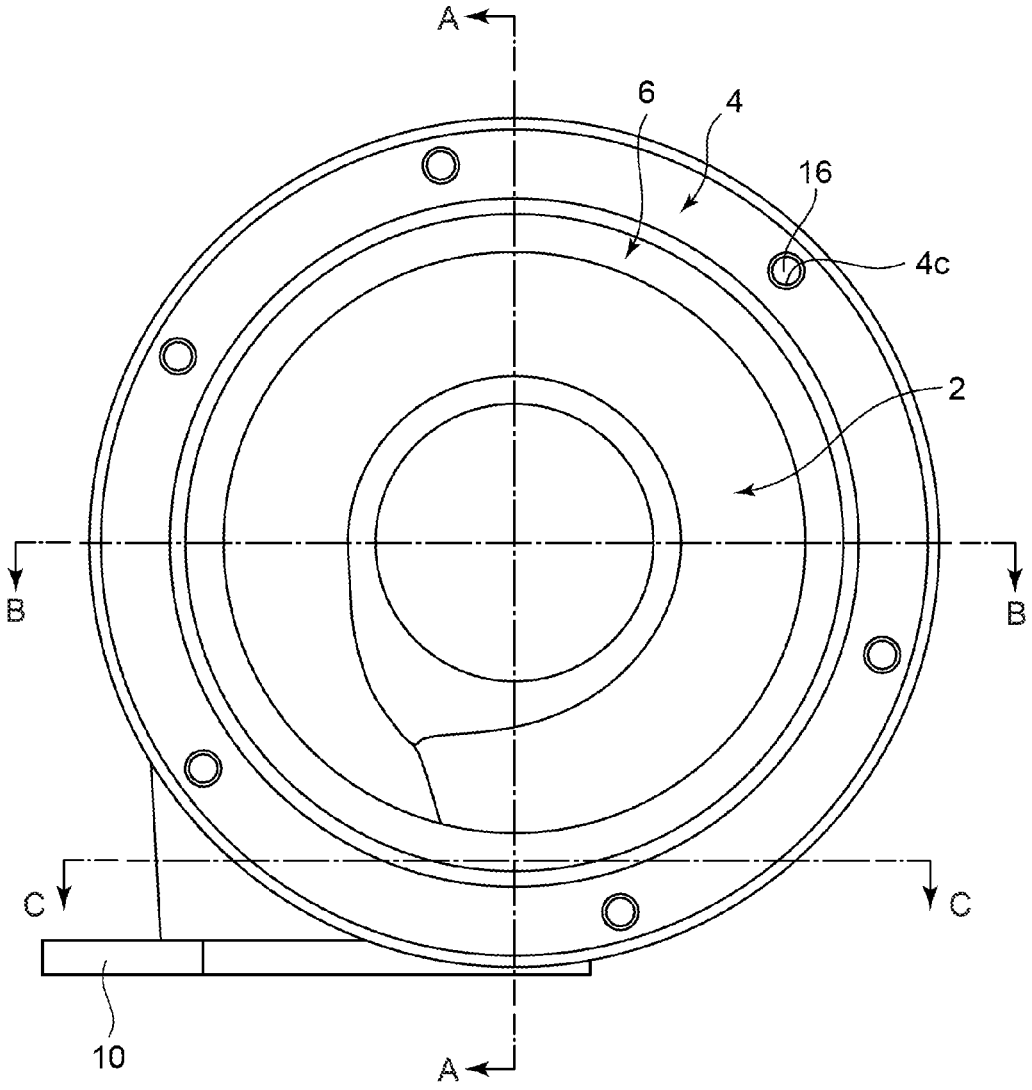
FIG. 3 is a front view of the turbine housing assembly of the present invention.
Figure 4:
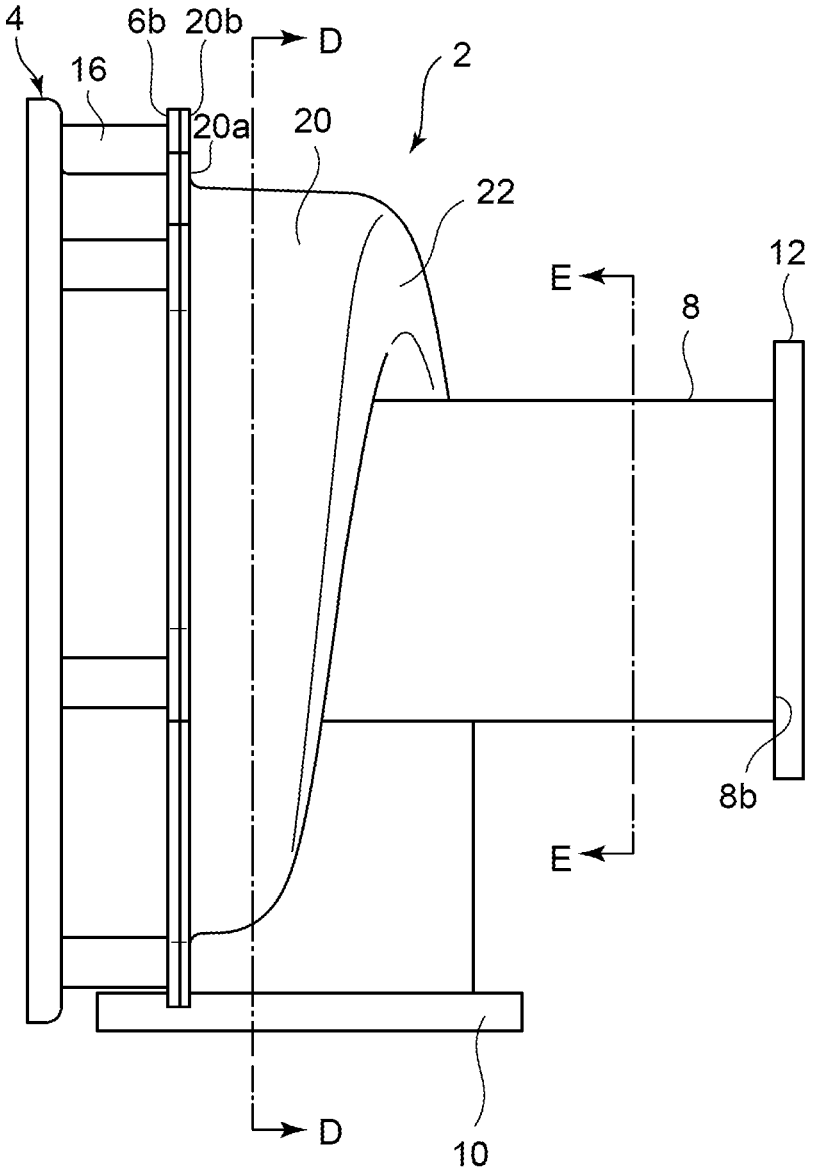
FIG. 4 is a side view of the turbine housing assembly of the present invention.

FIG. 1 is a perspective view of a turbine housing assembly of the present invention. FIG. 2 is an exploded perspective view of the turbine housing assembly of the present invention. Further, FIG. 3 is a front view of the turbine housing assembly of the present invention. FIG. 4 is a side view of the turbine housing assembly of the present invention. FIGS. 5 to 9 are cross-sectional views taken along lines A-A to E-E of FIGS. 3 and 4.

Although not particularly limited to this, a turbine housing assembly 1 of the present invention is a turbine housing of a VG (variable geometry) turbocharger including a variable nozzle mechanism, for instance. The VG turbocharger includes a variable nozzle mechanism in a turbine housing and controls the amount of exhaust gas flow to be introduced by adjusting the opening degree of the nozzles in the variable nozzle mechanism according to the conditions of the engine. Then, the VG turbocharger controls the supply pressure to the optimum pressure by increasing or decreasing the rotation speed of a turbine wheel by the amount of exhaust gas flow.

A turbine housing assembly 1 of the present invention is configured as illustrated in FIG. 1 by assembling a plurality of constituent members such as a scroll part 2, a connection part 4, an annular lid part 6, and an exhaust part 8 as illustrated in FIG. 2. Then, as illustrated in FIG. 1, a variable nozzle mechanism 3 and a turbine wheel 5 are inserted into the assembled turbine housing assembly 1 from the front side thereof. Further, a bearing housing (not illustrated) for housing a bearing that rotatably supports a rotation shaft of the turbine wheel 5 is connected to the front side of the assembled turbine housing assembly 1.

Figure 6:
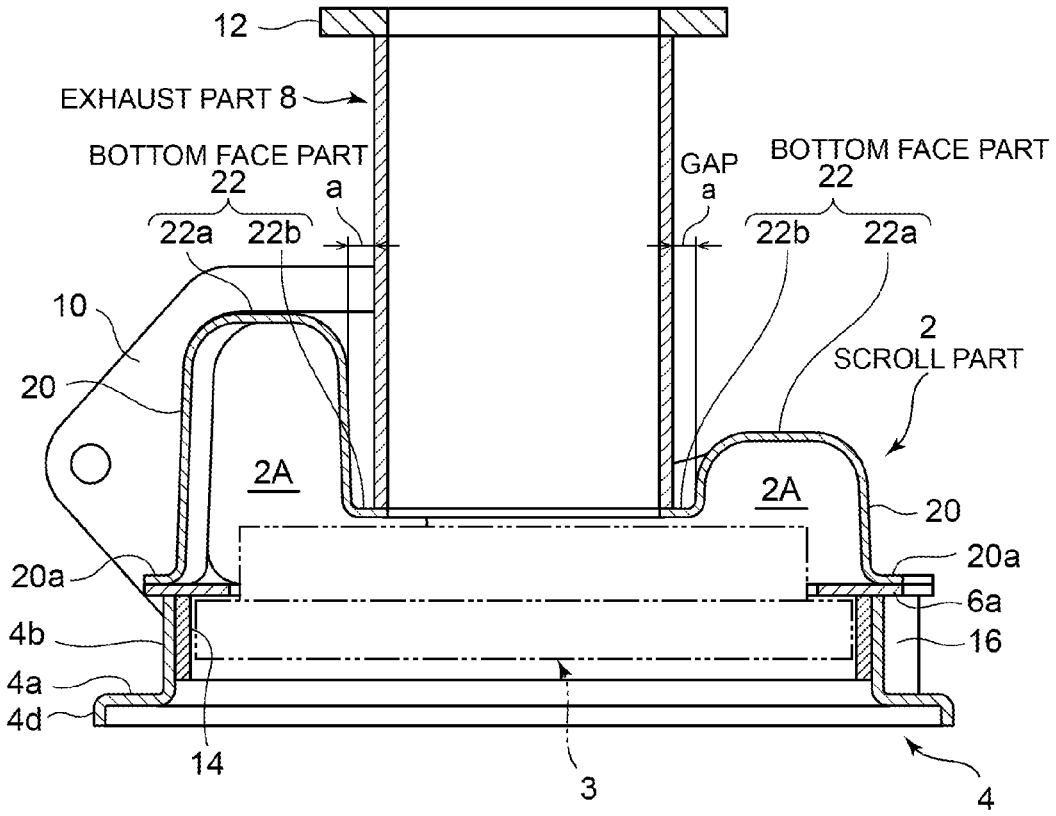
FIG. 6 is a cross-sectional view taken along line B-B of FIG. 3.
Figure 7:
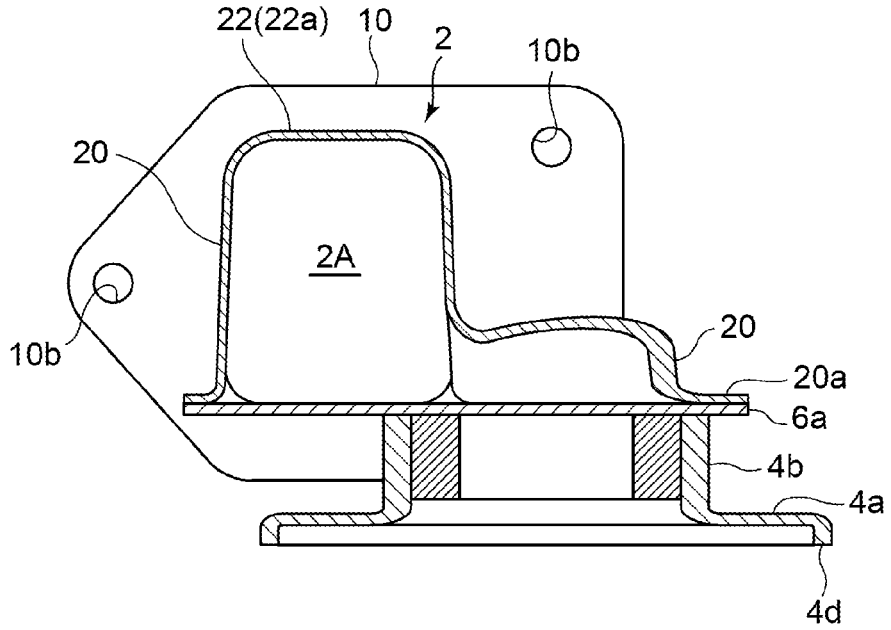
FIG. 7 is a cross-sectional view taken along line C-C of FIG. 3.

As illustrated in FIGS. 1, 2, 6 and so on, the scroll part 2 has a bottomed cylindrical shape including a surrounding wall part 20 and a bottom face part 22. Further, as illustrated in FIG. 8, an exhaust gas flow path 2A is formed into a spiral shape along the surrounding wall part 20 inside the scroll part 2 of a bottomed cylindrical shape, while an exhaust gas outlet 2B is disposed on the bottom face part 22, the exhaust gas outlet 2B having a through hole thereon at a position surrounded by the exhaust gas flow path 2A formed into a spiral shape.

Figure 5:
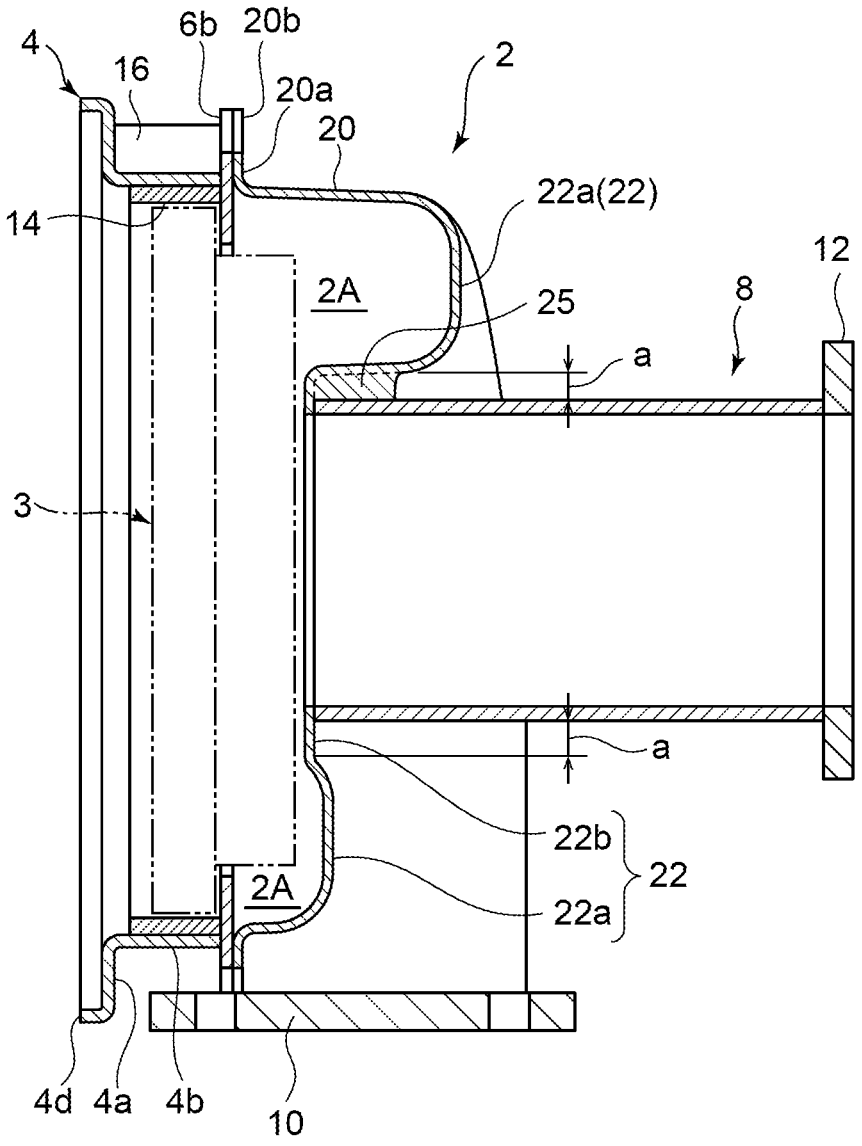
FIG. 5 is a cross-sectional view taken along line A-A of FIG. 3.

As illustrated in FIGS. 5 and 6, the bottom face of the exhaust gas flow path 2A of a spiral shape has a shape projecting toward the back face side of the bottom face part 22. Further, a cross-section of the flow path is formed so as to become shallow monotonically in a predetermined turning direction. Accordingly, the back face side of the bottom face part 22 is formed to have an uneven surface, including a recess portion 22*b* through which the exhaust gas outlet 2B is formed and a projecting portion 22*a* formed into a projecting shape that surrounds the recess portion 22*b*.

Further, as illustrated in FIGS. 2, and 4 to 7, a flange portion 20*a* is formed on an edge of the surrounding wall part 20, the flange portion 20*a* protruding outward in a direction substantially perpendicular with respect to the surrounding wall part 20. Also, a plurality of positioning portions 20*b* are formed on the flange portion 20*a* with equal intervals in the circumferential direction, the positioning portions 20*b* protruding outward from the flange portion 20*a*.

Figure 8:
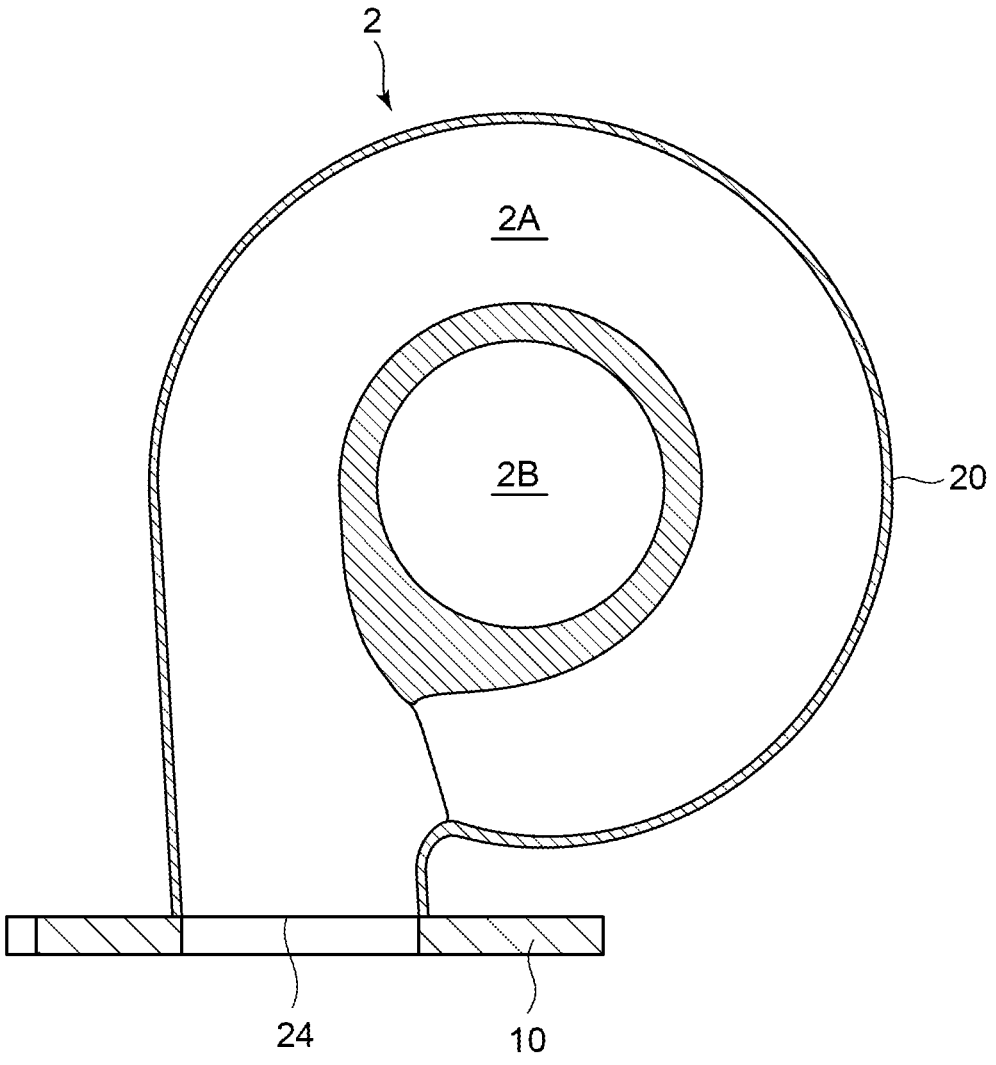
FIG. 8 is a cross-sectional view taken along line D-D of FIG. 4.

Still further, as illustrated in FIGS. 2, 8 and so on, an exhaust gas inlet 24 is formed on the upstream end of the exhaust gas flow path 2A. To the exhaust gas inlet 24, an engine-side flange portion 10 of a flat plate-like shape is connected by, for instance, welding. The engine-side flange portion 10 has bolt insertion holes 10*b* formed thereon so as to be fastened to an exhaust duct (not illustrated) by bolts. Accordingly, exhaust gas having a high temperature discharged from the engine flows through the exhaust duct to be introduced into the exhaust gas flow path 2A, passing through the exhaust gas inlet 24 from an opening 10*a* of the engine-side flange portion 10. The introduced exhaust gas is, after rotating the above described turbine wheel 5, discharged from the exhaust gas outlet 2B.

As illustrated in FIGS. 2, 5, 6 and so on, the connection part 4 includes a flange portion 4*a* of an annular and flat plate-like shape and a protruding portion 4*b* of an annular shape protruding perpendicularly with respect to the flange portion 4*a*. The flange portion 4*a* has a plurality of bushing insertion holes 4*c* formed thereon with equal intervals in the circumferential direction of the flange portion 4*a*. It is configured such that a threaded bushing 16 that has a cylindrical shape and threads formed on its hole is inserted into each of the bushing insertion holes 4*c*. The threaded bushings 16 are used as bolt holes for fastening the above described bearing housing and the connection part 4 by bolts.

As illustrated in FIG. 2, the annular lid part 6 includes a flat plate-like part 6*a* of an annular shape and positioning portions 6*b* protruding outward from the flat plate-like part 6*a*. The positioning portions 6*b* are disposed on the positions corresponding to the positioning portions 20*b* of the scroll part 2 and the bushing insertion holes 4*c* of the connection part 4 described above with the same intervals as the above.

The scroll part 2, the connection part 4, and the annular lid part 6 are each formed by processing a single piece of sheet metal. That is, each of the above is formed by plastic-deforming a flat plate-like piece of sheet metal into a predetermined shape by processes such as bending and pressing, or by partially cutting-off unnecessary portions by processes such as punching. Further, as a material of the scroll part 2, connection part 4, and annular lid part 6, for instance, a heat-resistant steel such as austenite stainless steel may be suitably used.

As illustrated in FIG. 2, the exhaust part 8 is formed into a tubular shape. Further, an end portion 8*a* of the exhaust part 8 is connected to the recess portion 22*b* at the back face side of the bottom face part 22 of the scroll part 2 described above by welding for instance, to be in communication with the exhaust gas outlet 2B. Meanwhile, to the other end portion 8*b* of the exhaust part 8, a muffler-side flange portion 12 including an annular and flat plate-like member is connected by, for instance, welding. With the muffler-side flange portion 12 being connected to a muffler-side exhaust duct (not illustrated), exhaust gas that has flowed through the exhaust part 8 passes through the muffler-side exhaust duct to be discharged outside of the vehicle from a muffler.

Still further, as illustrated in FIGS. 5 and 6, a gap "a" is formed between the projecting portion 22*a* and the outer circumferential face of the exhaust part 8 connected to the recess portion 22*b* of the scroll part 2. With the exhaust part 8 being connected to the scroll part 2 so that the gap "a" is formed between the projecting portion 22*a* of the scroll part 2 and the outer circumferential face of the exhaust part 8, it becomes difficult for the exhaust gas having a high temperature and flowing through the exhaust gas flow path 2A to affect the exhaust part 8. Here, in the present invention, the gap "a" between the outer circumferential face of the exhaust part 8 and the projecting portion 22*a* means a distance which separates the outer circumferential face of the exhaust part 8 and the projecting portion 22*a* in a direction perpendicular to the outer surface of the exhaust part 8.

In other words, as exhaust gas that has passed through the turbine wheel 5 expands so that its temperature decreases in the first place, the temperature of the exhaust gas flowing into the exhaust part 8 is lower than that of the exhaust gas flowing through the exhaust gas flow path 2A by approximately 100 degrees. Accordingly, with the exhaust part 8 and the scroll part 2 being connected so that the gap "a" is formed between the outer circumferential face of the exhaust part 8 and the projecting portion 22*a*, it becomes difficult for the exhaust gas having a high temperature and flowing through the exhaust gas flow path 2A to affect the exhaust part 8. Thus, it is possible to select a material of the exhaust part 8 in accordance with the temperature of the exhaust gas that passes through the exhaust part 8. As a result, it is possible to form the exhaust part 8 of a material having less heat resistance than that of the scroll part 2 (specifically, a stainless material that contains less nickel and is less expensive).

Figure 9:
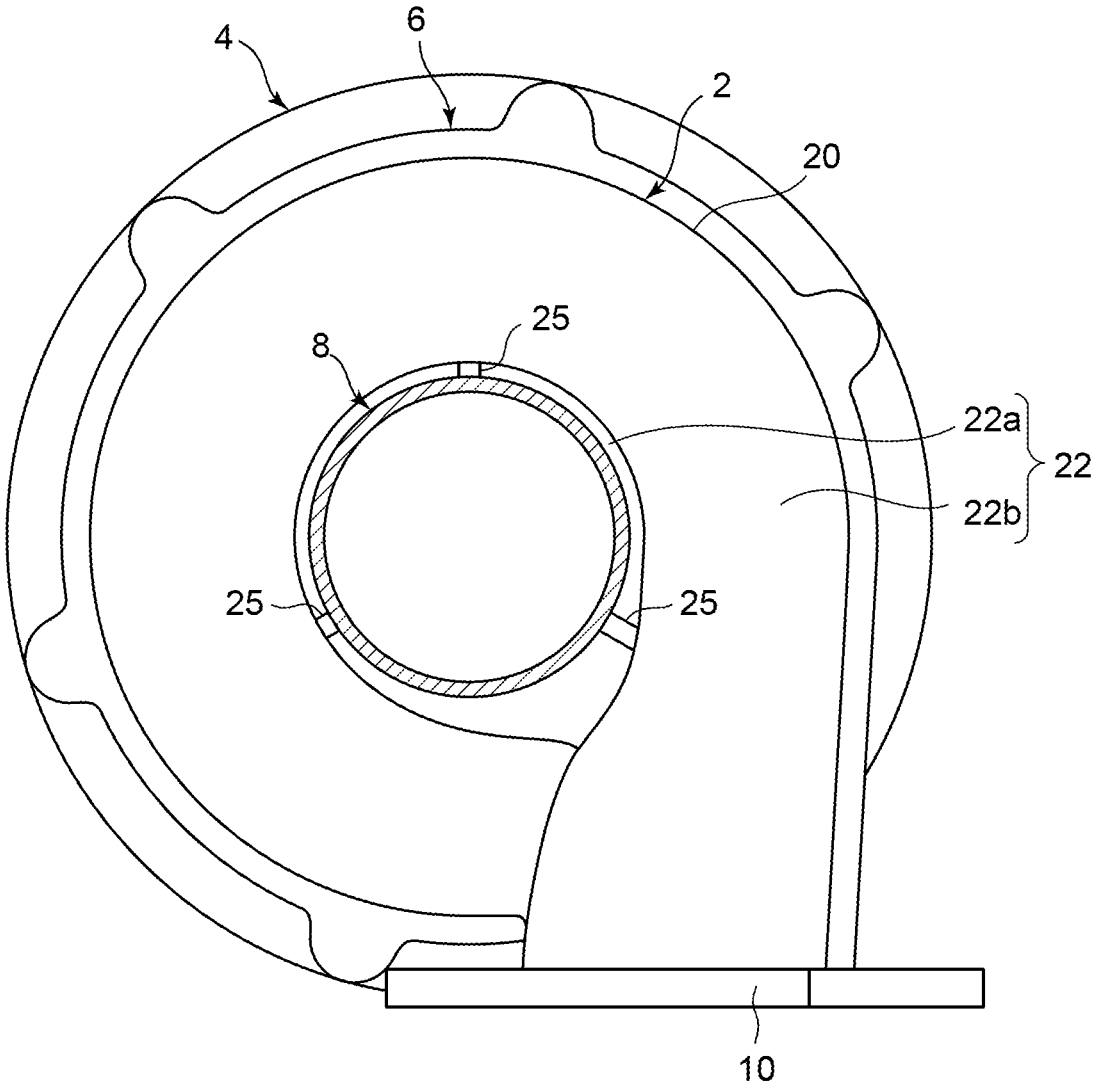
FIG. 9 is a cross-sectional view taken along line E-E of FIG. 4.

Further, as illustrated in FIG. 5, reinforcement ribs 25 are disposed on the inner circumferential side of the projecting portion 22*a* of the scroll part 2. The reinforcement ribs 25 are connected to the outer circumferential face of the exhaust part 8 by, for instance, welding. Also, as illustrated in FIG. 9, a plurality of (for instance, three) reinforcement ribs 25 are disposed with equal intervals in the circumferential direction. By providing such reinforcement ribs 25, the scroll part 2 and the exhaust part 8 are connected to each other even more securely.

Here, as illustrated in FIG. 5, the reinforcement ribs 25 of the present embodiment are provided integrally with the projecting portion 22*a* of the scroll part 2. However, the present invention is not limited to this. For instance, although not illustrated, the reinforcement ribs 25 may be provided integrally with the exhaust part 8 and connected to the inner circumferential side of the projecting portion 22*a*. Also for instance, the reinforcement ribs 25 may be provided separately from the scroll part 2 and the exhaust part 8, and connected to the inner circumferential side of the projecting portion 22*a* and the outer circumferential face of the exhaust part 8.

Further, as illustrated in FIG. 2, a ring member 14 of an annular shape is inserted to be fitted into the connection part 4 from the front side thereof. As illustrated in FIGS. 5, 6 and so on, the ring member 14 is inserted to and fitted at a position where it contacts the annular lid part 6. Then, the variable nozzle mechanism 3 is inserted into the inner circumferential side of the ring member 14. With the above described ring member 14 being inserted and fitted into the connection part 4, it is possible to easily determine the position of the variable nozzle mechanism 3.

As described above, for the turbine housing assembly 1 of the present invention, a turbine housing is broken down into modules such as the scroll part 2 inside which the exhaust gas flow path of a spiral shape is formed and the exhaust part 8 of a tubular shape, the scroll part 2 being formed by processing a single piece of sheet metal. Also, the recess portion 22*b* of the scroll part 2 and the end portion 8*a* of the exhaust part 8 are connected to each other in the turbine axial direction, so that the exhaust part 8 is brought into communication with the exhaust gas outlet 2B of the scroll part 2 in a state where the gap "a" is formed between the outer circumferential face of the exhaust part 8 and the projecting portion 22*a* of the scroll part 2.

As described above, since a turbine housing is broken down in to the scroll part 2 and the exhaust part 8, the scroll part 2 being formed by processing a single piece of sheet metal, it is possible to reduce the heat capacity and weight of the turbine housing. Also, since the scroll part 2 is formed by processing a single piece of sheet metal, its manufacture is facilitated.

Also, as described above, since a turbine housing is broken down into modules such as the scroll part 2 and the exhaust part 8, the exhaust part 8 being brought into communication with the exhaust gas outlet 2B of the scroll part 2 in a state where the gap "a" is formed between the outer circumferential face of the exhaust part 8 and the projecting portion 22*a* of the scroll part 2, it becomes difficult for the exhaust gas having a high temperature and flowing through the exhaust gas flow path 2A of the scroll part 2 to affect the exhaust part 8. Thus, it is possible to form the exhaust part 8 of a material having lower heat resistance than that of the scroll part 2. Specifically, it is possible to form the exhaust part 8 of a less expensive stainless material containing less nickel than the scroll part 2. As a result, it is possible to reduce the cost of the turbine housing.

Further, as described above, with the reinforcement ribs 25 formed between the outer circumferential face of the exhaust part 8 and the projecting portion 22*a* of the scroll part 2, it is possible to enhance the strength of the connection between the scroll part 2 and the exhaust part 8.

Still further, as described above, in the turbine housing assembly 1 of the present invention, the connection part 4 is formed by processing a single piece of sheet metal and includes a separate body separate from the scroll part 2. Also, the scroll part 2 and the connection part 4 are connected to each other in the turbine axial direction via the annular lid part 6 that is orthogonal to the turbine axial direction.

In this manner, by breaking down a turbine housing into modules such as the scroll part 2, the exhaust part 8, and the connection part 4 so that the connection part 4 has a separate body separate from the scroll part 2, it is possible to form each constituent member of the turbine housing assembly 1 of the present invention into a simple shape, thereby facilitating manufacture of each constituent member. Also, since the scroll part 2 and the connection part 4 are connected in the turbine axial direction via the annular lid part 6 orthogonal to the turbine axial direction line 7, the constituent members such as the connection part 4, the annular lid part 6, the scroll part 2, and the exhaust part 8 are all connected in the turbine axial direction. As a result, the assembling property of the turbine housing assembly 1 is improved.

Further, as described above, since a turbine housing is broken down into modules such as the scroll part 2 inside which the exhaust gas flow path 2A of a spiral shape is formed, the exhaust part 8 of a tubular shape, and the connection part 4 connectable to a bearing housing, it is possible to configure the turbine housing assembly 1 of the present invention as an assembly of a plurality of standardized constituent modules. As a result, it is possible to facilitate manufacture of a turbine housing.

Further, as described above, since the connection part 4 is formed by processing a single piece of sheet metal as well as the scroll part 2, it is possible to reduce the heat capacity and weight of the turbine housing. Also, since the connection part 4 is formed by processing a single piece of sheet metal, its manufacture is facilitated.

Still further, as described above, since a turbine housing is broken down into modules such as the scroll part 2, the exhaust part 8 and the connection part 4, the scroll part 2 and the connection part 4 being connected to each other by welding, the sealability is enhanced and thus the conventional outer shell is no longer required. As a result, it is possible to reduce the weight and heat capacity of the turbine housing.

Moreover, as described above, since a turbine housing is broken down into modules such as the scroll part, the exhaust part 8, and connection part 4, the scroll part 2 and the connection part 4 being connected to each other in the turbine axial direction via the annular lid part 6 that is orthogonal to the turbine axial direction line 7, it is possible to block the influence of the exhaust gas having a high temperature in the scroll part 2 by the annular lid part 6. Thus, it is possible to form the connection part 4 of a stainless material having lower heat resistance than that of the scroll part 2, i.e., a less expensive stainless material containing less nickel than the scroll part 2. As a result, it is possible to reduce the cost of the turbine housing compared to the case where a whole turbine housing is formed of a single material.

Furthermore, as described above, since the annular lid part 6 has a separate body separate from the scroll part 2 and the connection part 4, it is possible to form each constituent member such as the scroll part 2, the connection part 4, and the annular lid part 6 into a simple shape, thereby facilitating the manufacture of each constituent member. Also at this time, forming the annular lid part 6 by processing a single piece of sheet metal also contributes to reduction of the weight and heat capacity of the turbine housing.

According to the present invention, it is possible to provide a turbine housing in which reduction of weight, cost-cutting, facilitation of manufacture, reduction of heat capacity are even more promoted compared to a conventional turbine housing made of sheet metal.

Embodiments of the present invention were described in detail above, but the present invention is not limited thereto, and various amendments and modifications may be implemented within a scope that does not depart from the present invention.

Figure 10:
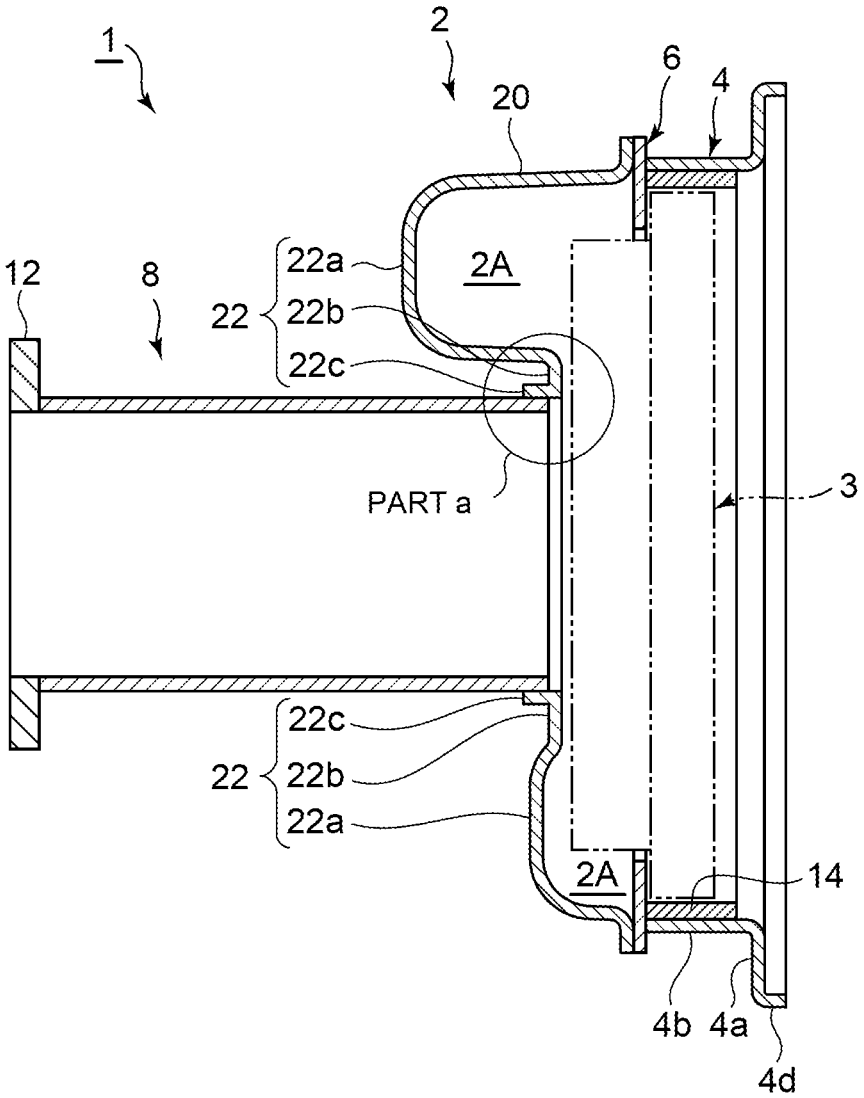
FIG. 10 is a cross-sectional view of a turbine housing assembly of another embodiment of the present invention.
Figure 11:
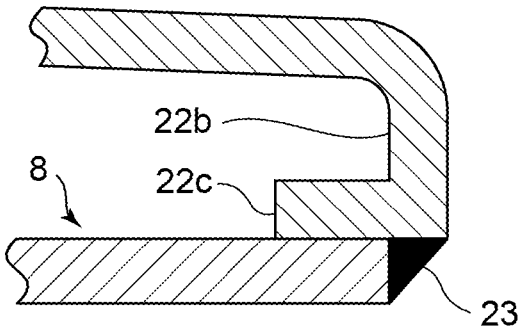
FIG. 11 is an enlarged view of part "a" of FIG. 10.

For instance, FIG. 10 is a cross-sectional view of a turbine housing assembly of another embodiment of the present invention. As illustrated in the drawing, the scroll part 2 of the present invention may include a fit-in portion 22*c* formed on the bottom face part 22, the fit-in portion 22*c* being formed by bending the bottom face part 22 around the exhaust gas outlet 2B toward the back face side so that the end portion 8*a* of the exhaust part 8 can be inserted and fitted therein. With such a fit-in portion 22*c*, it is possible to insert and fit the end portion 8*a* of the exhaust part 8 into the fit-in portion 22*c* to connect the end portion 8*a* to the inner circumferential side of the fit-in portion 22*c* by a fillet weld 23 as illustrated in FIG. 11, for instance. As a result, by inserting and fitting the end portion 8*a* of the exhaust part 8 into the fit-in portion 22*c*, it is possible to perform determination of the position and temporary joint for welding at the same time for the exhaust part 8, which leads to high workability in welding.

INDUSTRIAL APPLICABILITY

The present invention can be suitably used as a turbine housing assembly for a turbocharger, preferably a turbine housing assembly for a VG turbocharger to be mounted on a vehicle.

The invention claimed is:

1. A turbine housing assembly including a plurality of constituent members connected to one another to constitute a turbine housing into which a turbine wheel rotated by exhaust gas introduced from an engine is inserted, the turbine housing assembly at least comprising:

a scroll part of a bottomed cylindrical shape that has a surrounding wall part and a bottom face part, the scroll part including:

an exhaust gas flow path of a spiral shape formed inside the bottomed cylindrical shape and configured such that exhaust gas that has flowed in from an exhaust gas inlet flows through the exhaust gas flow path; and an exhaust gas outlet having a through hole formed on the bottom face part, the exhaust gas outlet being configured such that the exhaust gas that has flowed through the exhaust gas flow path flows out from the exhaust gas outlet; and an exhaust part of a tubular shape comprising a separate body separate from the scroll part, the scroll part being formed by processing a single piece of sheet metal so that, on a back face side of the bottom face part of the scroll part, a recess portion through which the trough-hole of the exhaust gas outlet is formed and a projecting portion formed by a bottom surface of the exhaust gas flow path projecting toward the back face side are formed, the projecting portion surrounding the recess portion, and the recess portion of the scroll part being connected to an axial end surface of an end portion of the exhaust part in a turbine axial direction so that only the axial end surface of the exhaust part is in contact with the scroll part when the exhaust part is in communication with the exhaust gas outlet of the scroll part in a state where the exhaust part is not in contact with the projecting portion of the scroll part and a gap is formed between an outer circumferential face of the exhaust part and the projecting portion of the scroll part.

2. The turbine housing assembly according to claim 1, wherein the exhaust part is formed of a material that has a heat resistance strength lower compared to the scroll part.

3. The turbine housing assembly according to claim 2, wherein the exhaust part is formed of a material that contains less nickel than the scroll part.

4. The turbine housing assembly according to claim 1, wherein a rib is formed between the outer circumferential face of the exhaust part and the projecting portion of the scroll part.

5. The turbine housing assembly according to claim 1, further comprising a connection part, the connection part being formed by processing a single piece of sheet metal separately from the scroll part, wherein the scroll part and the connection part are each welded to an annular lid part that is orthogonal to the turbine axial direction so as to be connected to each other in the turbine axial direction via the annular lid part.

6. The turbine housing assembly according to claim 5, wherein the annular lid part comprises a separate body separate from the scroll part and the connection part.

7. The turbine housing assembly according to claim 6, wherein the annular lid part is formed by processing a single piece of sheet metal.

8. The turbine housing assembly according to claim 5, further comprising a variable nozzle mechanism configured to adjust flow of the exhaust gas flowing toward the turbine wheel, the variable nozzle mechanism being inserted into the scroll part and the connection part.

9. The turbine housing assembly according to claim 1, wherein the recess portion of the scroll part is welded to the end surface of the end portion of the exhaust part in the turbine axial direction.

10. The turbine housing assembly according to claim 1, further comprising a connection part being formed by processing a single piece of sheet metal; and an annular lid part being formed by processing a single piece of sheet metal, the annular lid part including a flat plate-like part that extends orthogonal to the axial direction, wherein the connection part includes a flange portion having a flat plate-like shape and a protruding portion protruding perpendicularly with respect to the flange portion, the scroll part includes a flange portion protruding outward from an edge portion of the surrounding wall part, and the protruding portion of the connection part is welded to the one surface of the annular lid part and the flange portion of the scroll part is welded to the other surface of the annular lid part.

* * * * *